US005333889A

United States Patent [19]

Piegay et al.

[11] Patent Number: 5,333,889

[45] Date of Patent: Aug. 2, 1994

[54] BOARD FOR SLIDING, PROVIDED WITH A DEVICE FOR DAMPING VIBRATIONS

[75] Inventors: Yves Piegay, Etang; Jean Bauvois, Villars de Lans, both of France

[73] Assignee: Skis Rossignol S.A., Voiron, France

[21] Appl. No.: 971,588

[22] Filed: Nov. 5, 1992

[30] Foreign Application Priority Data

Nov. 25, 1991 [FR] France ..... 91 14760

[51] Int. Cl.[5] ..... A63C 5/075

[52] U.S. Cl. ..... 280/602; 280/607; 280/610

[58] Field of Search ..... 280/601, 602, 610, 607, 280/617, 636

[56] References Cited

U.S. PATENT DOCUMENTS

| | | | |
|---|---|---|---|
| 3,537,717 | 11/1970 | Caldwell | 280/602 |
| 3,901,522 | 8/1975 | Boehm | 280/610 |
| 4,405,149 | 9/1983 | Piegay | 280/602 |
| 4,412,687 | 11/1983 | Andre . | |
| 4,438,946 | 3/1984 | Piegay | 280/602 |
| 4,865,345 | 9/1989 | Piegay | 280/602 |
| 4,995,630 | 2/1991 | Piegay . | |
| 5,035,442 | 7/1991 | Arnsteiner | 280/602 |
| 5,143,395 | 9/1992 | Mayr | 280/602 |
| 5,199,734 | 4/1993 | Mayr | 280/602 |

FOREIGN PATENT DOCUMENTS

| | | | |
|---|---|---|---|
| 2237653 | 2/1975 | France . | |
| 2437225 | 4/1980 | France . | |
| 2575393 | 7/1986 | France . | |
| 2616340 | 12/1988 | France | 280/602 |
| 2664823 | 1/1992 | France | 280/602 |
| 2665081 | 1/1992 | France | 280/602 |

*Primary Examiner*—Mitchell J. Hill
*Assistant Examiner*—Michael Mar
*Attorney, Agent, or Firm*—Browdy and Neimark

[57] ABSTRACT

This invention relates to a board for sliding over snow, such as a ski, snow surf or the like, provided with at least one vibration damper (9, 10) made of visco-elastic material (3) and plate or other stress element (4). At least one of these dampers (2, 5) has a complex section, for example an upturned U, so that it partially follows different planes (7, 8, 9) of the zone of the structure (1) on which it is added.

23 Claims, 4 Drawing Sheets

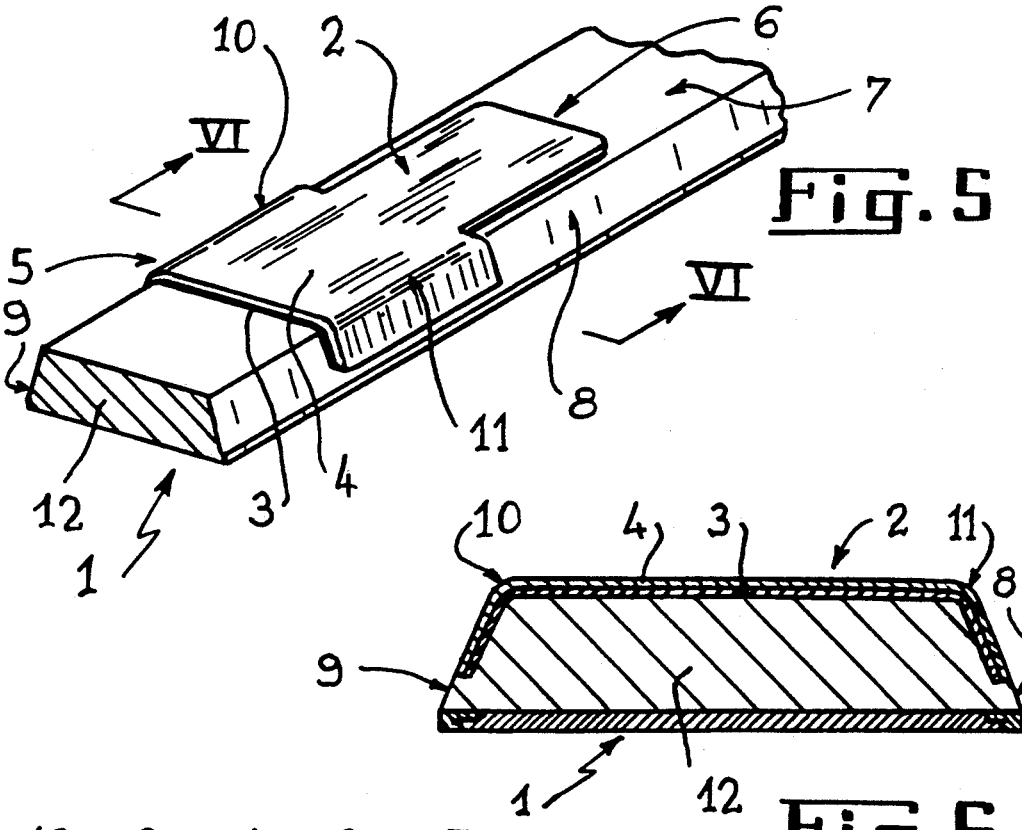
Fig. 5
Fig. 6
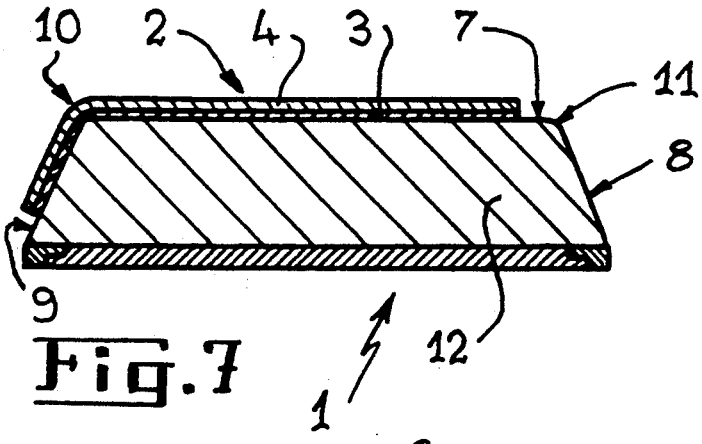
Fig. 7
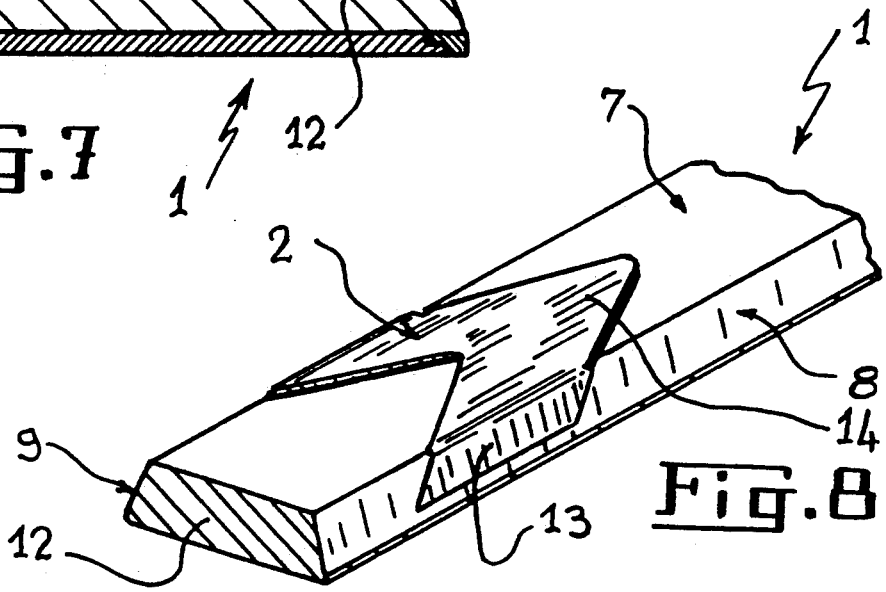
Fig. 8

BOARD FOR SLIDING, PROVIDED WITH A DEVICE FOR DAMPING VIBRATIONS

The present invention relates to a board for sliding over snow or the like, such as a ski, a snow surf, . . . , said board being provided with a device for damping the vibrations.

When moving over snow, a ski is subjected to shocks of various origins and of all types which cause said ski to vibrate. If such vibrations exceed a certain level, they are detrimental to the skier's comfort and to the general behaviour of the ski.

In particular, certain vibrations cause a loss of contact between the ski and the snow, which penalizes stability, grip and slide of the ski.

A ski is a beam of relatively complex shape, of which the centres of gravity of the different sections are not aligned. In addition, this position of the centres of gravity is variable as a function of the different structures.

Generally, an assembly subjected to an outside disturbance vibrates about one or more inherent frequencies which are characteristic of its structure and which result from its distributions of rigidity and of mass. The behaviour and sensations which result from these vibrations are influenced by the sum of the micro-displacements which are generated, in different directions. As is well known, the displacements are minimum at the vibration nodes and are maximum at the antinodes. Such vibrations are damped more or less quickly depending on the damping characteristics of the structure.

Among the vibrations to which a ski is subjected, the flexional vibrations in a plane perpendicular to the surface of the sole of the ski have formed the subject matter of much research. These vibrations essentially belong to the "first mode" of vibrations, i.e. to harmonic No. 1, and to the "third mode", i.e. to harmonic No. 3.

In accompanying FIGS. 1 to 3, FIG. 1 schematically shows a ski in side view, whilst FIGS. 2 and 3 respectively show the elastic lines of this ski in maximum amplitude in the first and the third vibration mode.

It should be noted that the first mode is predominant for a special slalom ski, whilst the third mode is predominant for a giant slalom ski.

In order to minimize the detrimental effects of this type of vibrations in a ski, it has already been proposed, according to document U.S. Pat. No. 3,901,522, to incorporate in the structure of the ski and over the whole of its length, a band of visco-elastic material. It has also been proposed, according to document U.S. Pat. No. 3,537,717, to place such a band on the upper face of the ski and in the entire zone going from the location of the shoe binding up to the origin of the tip. However, it has proved, upon use, that, in either case, the overall elimination of the vibrations was not favourable, as, in such cases, the vibrations are eliminated without any selection: it is true that the ski no longer vibrates, but it has lost its essential characteristics of stability, grip and liveliness.

Considering, therefore, that, although certain vibrations are detrimental, at least when they exceed a certain amplitude, certain other vibrations are, on the contrary, beneficial when they do not exceed a certain level, Applicants have described, in documents U.S. Pat. Nos. 4,405,149 and 4 438 946, skis comprising, integrated in their structure, bands of visco-elastic material whose position and length are determined as a function of the vibrations to be damped, and consequently as a function of the characteristics that the ski must present, depending on whether it is a special slalom ski or a giant slalom ski.

Other solutions have been envisaged for solving the problem of damping the flectional vibrations corresponding to the first and third mode, for example document FR-A-2 575 393. This describes damping systems constituted by layers of visco-elastic material which are stressed by plates with a high modulus of elasticity, such damper devices being placed on the surface of the ski and at judiciously chosen sites, at the level of the zones of maximum curvatures.

These different known devices, whether they are added to the structure of the board or whether they are incorporated in this structure, are efficient for the simple node of flexion in a direction perpendicular to the surface of the sole, but are not provided to respond to the combined flexion-torsion vibratory mode.

One object of the present invention is to solve, by a simple, inexpensive means, the problem of damping this combined flexion-torsion vibratory mode. FIG. 4 of the accompanying drawings schematically shows half of a ski, in plan view. The elastic line of this ski in the above-mentioned combined flexion-torsion mode has been shown in broken lines in this Figure.

The board for sliding according to the invention uses at least one damper device comprising at least one plate of visco-elastic material working in shear and associated with at least one stress element with a high modulus of elasticity which is either glued on this visco-elastic plate or embedded therein.

It may for example be question of a so-called "stress plate" damper device and be constituted, in manner known per se, (cf. for example document FR-A-2 575 393), on the one hand, by a plate of visco-elastic material whose coefficient of damping is for example at least 0.5 in an operating range extending in temperature from −30 to +30° C. and in frequency from 0 to 300 Hz, and, on the other hand, by a stress plate made of a material with a high modulus of elasticity, for example aluminium alloy. For each of these damper devices, the plate of visco-elastic material is then glued between the upper surface of the sliding board and the stress plate. To give an idea, the thickness of this plate of visco-elastic material is between 0.5 and 1.2 mm, whilst its coefficient of damping is included between 0.8 and 1.2, and the thickness of the stress plate is included between 0.5 and 1.2 mm.

For example, each damper comprises a stress plate of aluminium alloy, 0.6 mm thick, which is glued on a band of visco-elastic material 0.8 mm thick and of coefficient of damping of the order of 0.8, optimum for a temperature of −10° and for vibration frequencies of between 10 and 100 Hertz.

This damper device may also be a device composed of a plate of visco-elastic material in which steel wires are embedded, for example in accordance with document FR-A-2 437 225. Instead of steel wires, it may be question of glass or carbon filaments. Instead of wires, it may be question, for example in accordance with document FR-A-2 237 653, of a stress plate for example made of metal which is therefore embedded in a visco-elastic plate, this stress plate preferably being perforated.

The ski may therefore comprise at least one visco-elastic damper device of a type mentioned above, which is placed in the zone where the visco-elastic material is the most stressed in shear deformation. It absorbs and thus dissipates a quantity of energy which is not restored to the structure. The effect of the vibration is in that case modified by "blanketing" the amplitude of displacement of the structure.

FIGS. 2 and 4 show that the zones of maximum curvatures for a special slalom ski are positioned, for a given structure, in the zone referenced "A" for the simple mode of flexion and in zone "D" for the combined flexion-torsion mode of flexion.

On this ski, the optimal locations for positioning one or more dampers are therefore slightly offset. Moreover, as the planes of stress are orthogonal, it appears desirable to position the damping devices in different planes.

A similar reasoning may be made for a giant slalom ski. By comparing FIGS. 3 and 4, a shift is similarly observed between the zones of maximum curvatures B, C and D.

However, for the damping to be sufficient, it is necessary, on the one hand, that the surface of the damper device be sufficient, and, on the other hand, that it be constituted in one part in order to minimize to a maximum the lack of efficiency of the edges. The arrangement of a plurality of virtually plane dampers at various places of the structure does not respond sufficiently satisfactorily to these requirements.

One object of the invention is therefore to provide, for a determined zone, a single damper device which is efficient in the different planes of orientation of the structure of the ski.

The invention aims at improving the damping of the different modes of vibrations developing in the structure of a board for sliding, but in planes or surfaces oriented differently. The damper device used is positioned locally so that its active zones correspond, at the respective zones of maximum curvatures, to the different modes of vibration.

This board for sliding is of the type comprising at least one vibration-damper element which is either added to the structure of the board or incorporated therein, and which comprises, on the one hand, at least one plate made of visco-elastic material working in shear and, on the other hand, at least one stress element whose modulus of elasticity is very high with respect to that of this visco-elastic material, this stress element being either glued to the plate of visco-elastic material or embedded therein, and this damper device being positioned locally on or in the sliding board in determined zones thereof.

According to the invention, and in particular in order to dampen different modes of vibrations which develop in adjacent zones of the sliding board and in differently oriented planes or surfaces, simultaneously and in an improved manner, there is provided in these zones at least one damper device of the above-mentioned type but shaped so that its surface in contact with the structure of the sliding board, instead of being conventionally plane or perhaps more or less curved, partially follows the shape of these zones, consequently following, at least at certain spots, different planes of the sliding board, this damper device consequently having a three-dimensional shape combining a plurality of planes, oriented differently but of which at least one of them is substantially parallel to the upper plane of the board, the damper device being for example of L-section or in the form of a U-shaped staple.

The invention will be more readily understood and its advantages and other characteristics will appear upon reading the following description of a non-limiting embodiment with reference to the accompanying schematic drawings, in which:

As noted above, FIG. 1 schematically shows a ski in side view;

FIG. 2 schematically shows elastic lines of the ski of FIG. 1 in a simple mode of flexion.

FIG. 3 similarly schematically shows elastic lines of flexion for combined flexion-torsion.

FIG. 5 is a summary perspective view of a portion of an alpine ski equipped with a damper device according to the invention of the "stress plate" type.

FIG. 6 is a simplified transverse section, in direction VI—VI of FIG. 5, of a variant embodiment for which the damper is totally built in the structure of this ski.

FIG. 7 is a view similar to FIG. 6, but showing another variant embodiment.

FIG. 8 is a view similar to FIG. 5, but illustrating another variant embodiment.

Figure 1:
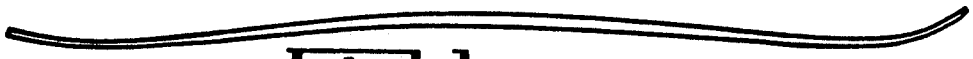
Figure 2:
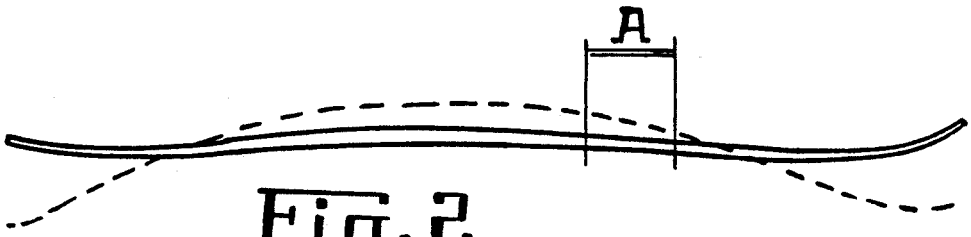
Figure 3:
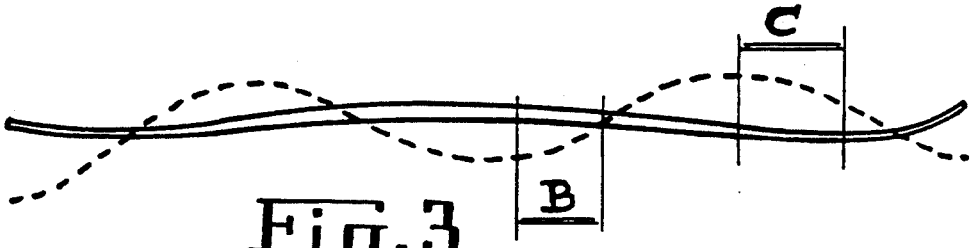
Figure 4:
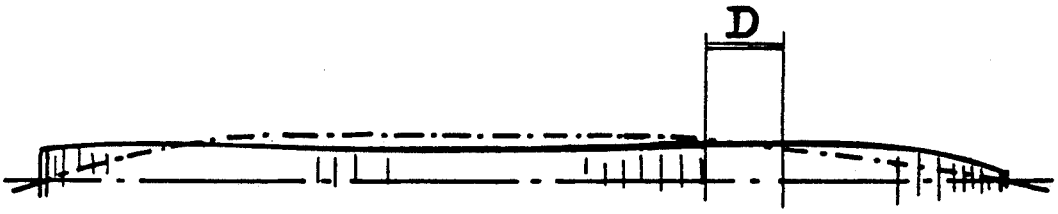
FIG. 4 is a schematic view showing flexion of a giant slalom ski.

Referring again to the drawings, FIG. 5 shows a portion of a snow ski 1, more precisely an alpine ski, on the surface of which is added a vibration-damper device 2.

This damper device 2 is, of course, in accordance with the teaching of the prior art, positioned locally on the ski 1 so that its active zones correspond to the maximum curvatures relative to the modes of vibration considered. However, it is very particular. It is question, of course, and in accordance with the teaching of the prior art, of a damper working in shear and comprising a plate of visco-elastic material 3 which is glued to the surface of the ski 1, and a conjugate plate 4 of a material with a high modulus of elasticity (for example aluminium alloy). However, the lower part 5 of this damper device 2 with stress plate does not take a continuous plane shape as is the case in this example for its upper part 6: as may be seen clearly in FIGS. 5 and 6, this device 2 has, in this lower zone 5, an upturned U section with short, flared branches, i.e. in fact a section which, according to the invention, is three-dimensional combining a plurality of differently oriented planes, with at least one of these planes (as is the case here for the base of the "U"), which is substantially parallel to the plane of the upper surface 7 of the ski.

This lower part 5 of the damper allows damping of vibrations which develop in three different planes or orientations, viz. plane 7 of the ski and planes 8, 9 of the edges of this ski.

Moreover, due to the offset of the zones of maximum curvatures of each of the vibratory modes, there is ascertained, in this embodiment, a difference in positioning of the active zones constituting the damper assembly with stress plate in order to respond to the differences in positioning of the zones of maximum curvatures of the modes of simple flexion and of flexion combined with torsion.

The coupling which is made by junctions 10 and 11 of the multiple faces of the stress plate 4 procures an unexpected effect which is much more efficient than that which would be procured by several dampers with virtually plane stress plate according to the prior art, and which would be placed, in these same zones close to section VI—VI, on these same adjacent faces of the structure of the ski.

Depending on the case, the damper device may, as is the case for FIG. 5, either simply be added on the surface of the ski, or, as illustrated in FIG. 6, be placed in a recess provided to that end and in at least two different planes in the structure 12 of the ski, so as to be flush with the rest of the surface of this ski, or, in accordance with a hybrid solution, have its lateral parts 13 (FIG. 8) embedded respectively in the edges 8, 9 of the ski so as to be flush therewith, and its upper part 14 (i.e. the one which covers a portion of the upper face 7 of the ski) simply added without embedding on this face 7.

It should be noted that FIG. 8 also illustrates another advantageous form for the damper 2.

It goes without saying that the invention is not limited to the examples which have just been described with reference to FIGS. 5, 6 and 8.

It has already been seen, in FIGS. 6 and 8, that the damper or dampers may be totally or partially embedded in recesses provided to that end in the structure of the ski, instead of being directly added thereon.

The section of the stress plate and therefore of the damper device may be of L-shape, as illustrated in FIG. 7, and not in U-shape. As shown in this same FIG. 7, it may be placed disymmetrically with respect to the median longitudinal axis of the board. It may also be with more or less rounded junctions, as a function of the shape of the structure of the board at that spot.

Figure 9:
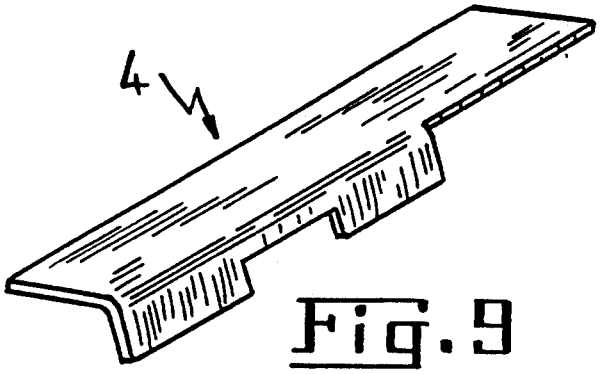
FIGS. 9 to 11 show other possible forms, among many others, for the stress plate.
Figure 10:
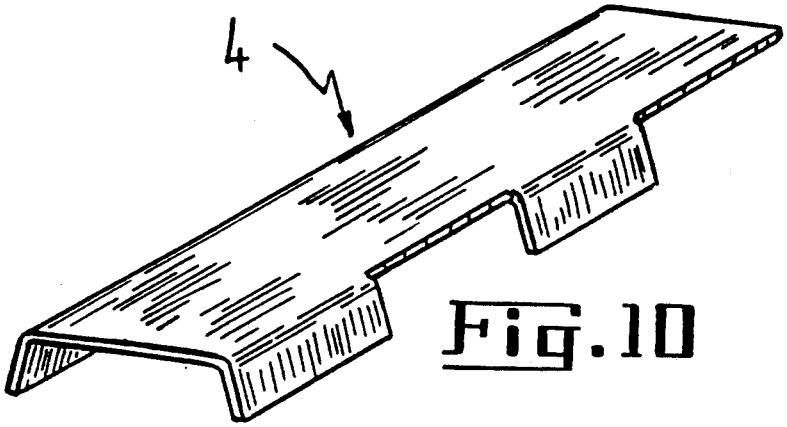
Figure 11:
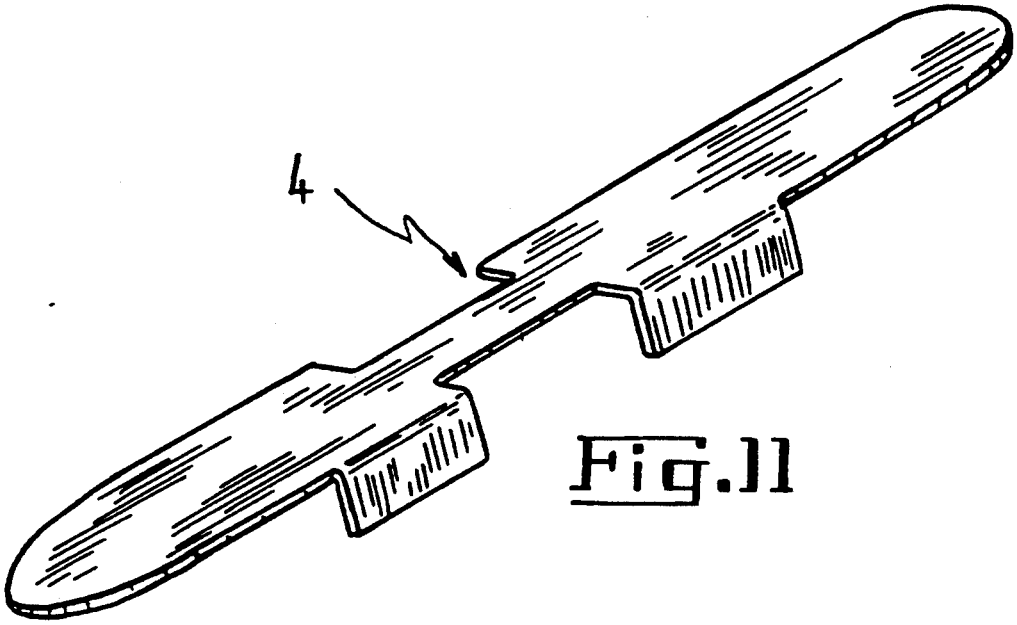

In accordance with FIGS. 9 to 11, where the stress plates 4 are given by way of non-limiting examples, this damper device may adopt very various shapes modulating the damping surfaces as a function of the intensity and positioning of the zones of curvature of the structure of the board. This form of damper device is adapted to the particular modes to be damped.

Such dampers may be multiple, the location thereof generally depending on the inherent structure of the sliding board.

The visco-elastic element 3 itself does not necessarily continuously follow the complex shape of the stress plate, but may be composed of several adjacent plates.

The same visco-elastic damper element 3 may be composed of a plurality of plates, either superposed or juxtaposed, of characteristics different with respect to one another, and this in the same plane of orientation or not.

The visco-elastic materials may also differ in the same way depending on their plane of orientation.

The thickness of the visco-elastic material may vary along the same visco-elastic plate; it may for example increase progressively from one end of this plate to the other and be for example of the order of 0.5 mm at one end and of the order of 2 mm at the other end.

Figure 12:
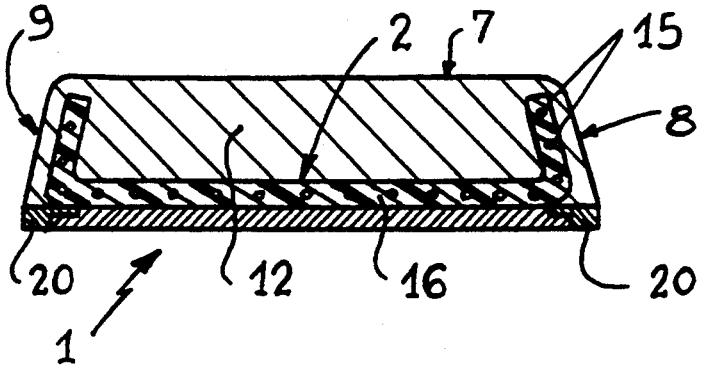
FIG. 12 is a view similar to FIG. 6, but illustrating an embodiment for which the damper device is of another type and is embedded in the structure of the ski.

FIG. 12 illustrates an embodiment according to which, on the one hand, the damper device 2 used is of another type, in this example of the type according to document FR-A-2 437 225 comprising stress wires 15 made of a material with a high modulus of elasticity (steel for example) which are embedded as shown in a plate 16 of visco-elastic material, and, on the other hand, this damper device 2 is embedded in the structure 12 of the ski 1, as shown.

This damper device 2 has a U-section. It may also take an upturned U section according to FIG. 6, or a recumbent L section according to FIG. 7, for example.

In a variant, these stress wires 15 may be distributed asymmetrically in the visco-elastic plate 16 instead of being symmetrically and regularly distributed as in FIG. 12.

The stress wires 15 may, of course, be replaced by a stress plate 15 in accordance with document FR-A-2 237 653 mentioned above.

Figure 13:
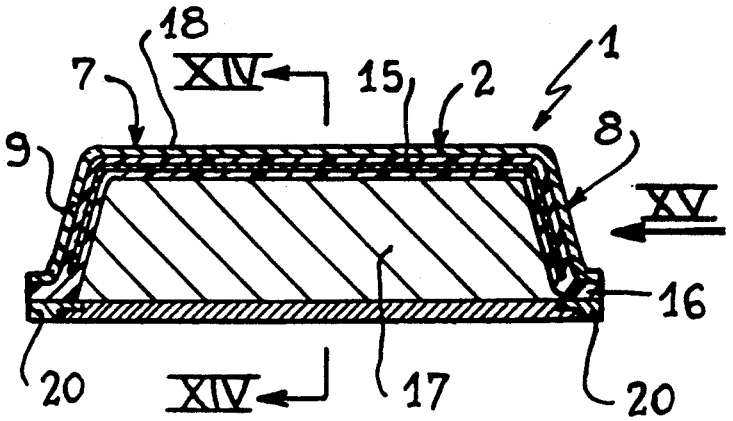
FIG. 13 is a view similar to FIG. 12, but illustrating a variant embodiment for which this damper device is placed just beneath the decorative layer of the ski.
Figure 14:
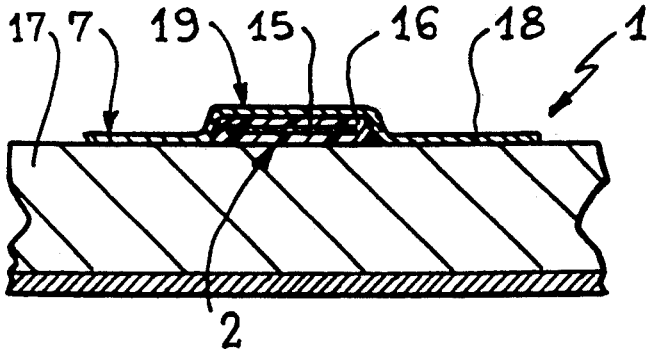
FIG. 14 is a partial longitudinal section along XIV—XIV of FIG. 13.
Figure 15:
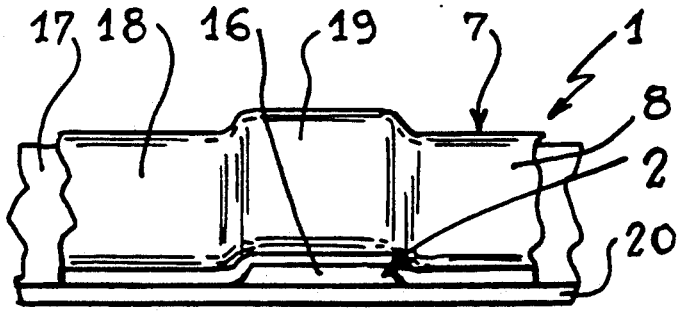
FIG. 15 is a partial side view of the latter ski, in the direction XV of FIG. 13.

Finally, FIGS. 13 to 15 illustrate an embodiment for which the damper device 2 is placed on the technical structure 17 of the ski 1, but beneath the decorative layer 18 thereof.

As shown in particular in FIG. 14, the damper in that case forms a visible protuberance 19 on the ski, which is advantageous by reason of its remoteness from the neutral fiber.

In addition, the visco-elastic layer 16 is seen on the edge of the ski, above edge 20, as shown in FIG. 15, which is advantageous from the commercial standpoint, as the consumer can appreciate visualizing the dampers which the manufacturer is boasting.

It should be noted that, in a variant, the damper device may also be embedded in the structure 17 of the ski as in FIG. 6, whilst being placed just beneath the decorative layer 18 as in FIG. 13.

What is claimed is:

1. In a board for sliding over snow, comprising a longitudinally extending body with a sliding surface, an upper surface and two opposite side walls; and at least one vibration damper device which comprises at least one plate of visco-elastic material working in shear and at least one stress element with a high modulus of elasticity, said stress element being adhered to said visco-elastic plate, said damper device being positioned locally on the board at a predetermined zone thereof, the improvement comprising means for simultaneously damping different modes of vibrations which develop in adjacent zones of the board but in differently oriented planes, there being provided in these zones at least one said damper device, said damper device being shaped and having a surface in contact with the sliding board structure which surface has a shape which partially conforms to the shape of these zones, said damper device having a first portion aligned with said upper surface and a second portion extending from said first portion aligned with one of said side walls and intersecting said first portion, said damper device thereby providing an enveloping form in three dimensions combining at least two different orientations.

2. The sliding board of claim 1, wherein the visco-elastic material of said damper device is a continuous plate which follows the same complex shape as its stress element.

3. The sliding board of claim 1, wherein at least one of said dampers comprises a plurality of juxtaposed visco-elastic plates of different characteristics.

4. The sliding board of claim 1, wherein at least one of said dampers comprises plates of visco-elastic materials of different characteristics depending on their plane of orientation.

5. The sliding board of claim 1, wherein said damper device is embedded in a recess provided to that end in at least two different planes of the structure of the board.

6. The sliding board of claim 1, wherein said damper device is placed disymmetrically with respect to the median longitudinal axis of the board.

7. The sliding board of claim 1, wherein the visco-elastic layer of said damper is left visible on each edge of the ski.

8. The sliding board of claim 1, wherein said stress element is constituted by wires with a high modulus of elasticity, such as steel wires.

9. The sliding board of claim 8, wherein the stress wires are distributed asymmetrically in the visco-elastic plate.

10. The sliding board of claim 1, wherein the thickness of said visco-elastic plate varies along said plate.

11. A board according to claim 1, wherein said longitudinally extending body is partially curved.

12. A board according to claim 1, wherein said upper surface of said board is curved.

13. In a board for sliding over snow, comprising a main body portion substantially extending in a main longitudinal direction, with:

a sliding surface intended to slide in contact with the snow, said sliding surface extending substantially in said longitudinal direction, an upper outer surface opposite said sliding surface, lateral outer sides joining said upper surface to said sliding surface, and at least one vibration damper, said vibration damper comprising a laminate of a visco-elastic material and at least one stress element with a high modulus of elasticity, said vibration damper being fixed at a predetermined localized position of said board, the improvement wherein said vibration damper comprises means for simultaneously damping different modes of vibrations which develop in adjacent zones of said board but in differently oriented planes, said vibration damper having:

a first portion extending substantially parallel to said upper outer surface of the board, and at least a second portion extending substantially along at least one of said lateral outer surfaces, the vibration damper thereby providing an enveloping form in three dimensions combining at least two differently oriented planes.

14. A board in accordance with claim 13 wherein said vibration damper extends in three different planes.

15. A board in accordance with claim 13, comprising two said vibration dampers.

16. A board according to claim 13 wherein said vibration damper has a shape, in cross-section, of an inverted U.

17. A board according to claim 13, wherein said vibration damper has a generally L-shape in cross-section.

18. A board according to claim 13 wherein said second portion of said vibration damper extends generally perpendicular to said first portion.

19. A board for sliding over now, comprising a longitudinally extending body with a sliding surface, an upper surface and two opposite side walls; and at least one vibration damper device which comprises at least one plate of visco-elastic material working in shear and at least one stress element with a high modulus of elasticity, said stress element being adhered to said visco-elastic plate, said damper device being positioned locally on the board at a predetermined zone thereof, the improvement comprising means for simultaneously damping different modes of vibrations which develop in adjacent zones of the board but in differently oriented planes, there being provided in these zones at least one said damper device, said damper device being shaped and having a surface in contact with the sliding board structure which surface has a shape which partially conforms to the shape of these zones, said damper device having a first portion aligned with said sliding surface and a second portion extending from said portion aligned with one of said side walls and intersecting said first portion, said damper device thereby providing an enveloping form in three dimensions combining at least two different orientations.

20. The sliding board of claim 19, wherein said stress element is constituted by wires with a high modulus of elasticity, such as steel wires.

21. A board in accordance with claim 19, wherein said damper device extends in three different planes.

22. A board according to claim 21, wherein said damper device has a generally U-shaped cross-section.

23. In a board for sliding over snow, comprising a main body portion substantially extending in a main longitudinal direction, with:

a sliding surface intended to slide in contact with the snow, said sliding surface extending substantially in said longitudinal direction, an upper outer surface opposite said sliding surface, lateral outer sides joining said upper surface to said sliding surface, and at least one vibration damper, said vibration damper comprising a laminate of a visco-elastic material and at least one stress element with a high modulus of elasticity, said vibration damper being fixed at a predetermined localized position of said board, the improvement wherein said vibration damper comprises means for simultaneously damping different modes of vibrations which develop in adjacent zones of said board but in differently oriented planes, said vibration damper having:

a first portion extending substantially parallel to said sliding surface of the board, and at least a second portion extending substantially along at least one of said lateral outer surfaces, the vibration damper thereby providing an enveloping form in three dimensions combining at least two differently oriented planes.

* * * * *